United States Patent [19]

Smet

[11] Patent Number: 5,002,138

[45] Date of Patent: Mar. 26, 1991

[54] STEERABLE DRILLING MOLE

[76] Inventor: Marc J. M. Smet, Kasteelstraat 29, 2400 Mol, Belgium

[21] Appl. No.: 481,244

[22] Filed: Feb. 20, 1990

[30] Foreign Application Priority Data

Apr. 28, 1989 [BE] Belgium ..... 8900475

[51] Int. Cl.[5] ..... E21B 7/08; E21B 47/022

[52] U.S. Cl. ..... 175/45; 175/61; 175/74; 175/107

[58] Field of Search ..... 175/61, 45, 73

[56] References Cited

U.S. PATENT DOCUMENTS

| | | | |
|---|---|---|---|
| 2,167,194 | 7/1939 | Anderson | 175/73 |
| 2,685,431 | 8/1954 | James | 175/61 X |
| 3,888,319 | 6/1975 | Bourne, Jr. et al. | 175/61 X |
| 4,655,299 | 4/1987 | Schoeffler | 175/61 X |
| 4,823,888 | 4/1989 | Smet | 175/45 |
| 4,907,658 | 3/1990 | Stangl et al. | 175/45 X |

OTHER PUBLICATIONS

Development of Directional Drilling, "The Lane–Wells Knuckle Joint", published by Lane–Wells, Mar.–Apr. 1938, 1 page.

*Primary Examiner*—Stephen J. Novosad
*Attorney, Agent, or Firm*—Foley & Lardner

[57] ABSTRACT

Steerable mole for making a hole (31) in the ground (30), which drilling mole has a round tubular body (1), a guidable drilling instrument (2, 3) mounted in front on this body (1) by means of a ball and socket joint (4, 5) and means (7–9) mounted in the body (1) in order to guide the drilling instrument (2, 3) in relation to the body (1), characterized in that the ball (4) of the ball and socket joint (4, 5) is fixed to the drilling instrument (2, 3), while the means (7–9) for guiding the drilling instrument (2, 3) have a steering element (7) situated in which turns round the longitudinal axis of the body (1) the body (1) of which the front is directed obliquely at this longitudinal axis of the body (1) and works together with the back of the ball (4) of the ball and socket joint (4, 5) and means (8, 9) to rotate the steering element (7) round the longitudinal axis of the body (1).

13 Claims, 2 Drawing Sheets

STEERABLE DRILLING MOLE

BACKGROUND OF THE INVENTION

The invention relates to a steerable mole for making a hole in the ground, which drilling mole has a round tubular body, a guidable drilling instrument mounted in front on this body by means of a ball and socket joint and means mounted in the body in order to guide the drilling instrument in relation to the body.

A steerable drilling mole of this sort is described in the Belgian patent no. 906 079 to the name of Nik Smet. In this known drilling mole the drilling instrument is formed by a head which is provided with one or more spraying devices for liquid under high pressure. The means for guiding this drilling instrument in relation to the tubular body are formed by three or more cylinder-piston mechanisms which are arranged around the geometric axis in the body. Cylinder-piston mechanisms are relatively expensive. The setting or adjusting of the correct direction of the drilling instrument with assistance of these cylinder-piston mechanisms is not always simple.

OBJECTS AND SUMMARY OF THE INVENTION

The invention has the aim of remedying these disadvantages and to provide a steerable drilling mole of the intended type for this purpose whereby the guiding of the drilling instrument may be accomplished very precisely in a very simple manner, and whereby the guiding of this instrument in relation to the body may be very precisely and easily measured.

For this purpose the ball of the ball and socket joint is fixed to the drilling instrument, while the means for guiding the drilling instrument have a steering element situated in the body which turns round the longitudinal axis of the body of which the front is directed obliquely at this longitudinal axis of the body and works together with the back of the ball of the ball and socket joint, and means to rotate the steering element round the longitudinal axis of the body.

Through the very easy and precise rotation of the steering element to be effected of which the position may easily and precisely be detected one can change the direction of the oblique front of this element through which also the inclination of the connecting ball of the ball and socket joint and thus also the direction of the whole drilling instrument are altered.

In a first embodiment of the invention the back of the ball of the ball and socket joint is directed obliquely at the longitudinal axis of the drilling instrument. Preferably the back of the ball forms an angle with a surface perpendicular to the longitudinal axis of the drilling instrument which is almost equal to the angle of the front of the steering element with a surface perpendicular to the longitudinal axis of the body.

In this embodiment the drilling instrument may directed in a direction whereby its longitudinal axis lies in the extension of the longitudinal axis of the body. Through rotation of the steering element this direction may be altered. The steering element need not be turned except during the changing of direction.

In the second embodiment of the invention the back of the ball of the ball and socket joint is directed perpendicular to the longitudinal axis of the drilling instrument.

With this embodiment the back of the ball is always inclined and the longitudinal axis of the drilling instrument always makes an angle with the longitudinal axis of the body. With a continuous even rotation of the steering element the last mentioned longitudinal axis will follow a conical path and drilling will occur in a straight line. At any moment one may precisely detect which position the steering element takes and as a result in which direction the drilling instrument is directed. By stopping the steering element one may drill further in the defined known direction in which the drilling instrument is directed at the moment of stopping.

Through the presence of the ball and socket joint, the great forces exerted on the drilling instrument are in main absorbed by this joint so that the engine which drives the steering element is minimally strained and so may be of relatively light weight construction.

The embodiments of the invention described for this purpose are especially interesting if the drilling instrument is moreover of the type that has a stationary part which connects with the ball of the ball and socket joint, a driven head in front of the stationary part, and means to drive the head.

This instrument may thereby be a drilling head whereby the head is provided with the necessary cutting or grinding elements and the means are driving means to rotate the head, as well as a drill hammer whereby the means are driving means to give the head a hammer movement, whether or not together with the rotation. In order to facilitate changing the direction of the drilling instrument the drilling instrument should preferably have a larger diameter in front than the body.

BRIEF DESCRIPTION OF THE DRAWINGS

Other details and advantages of the invention will appear from the following description of a steerable drilling mole according to the invention; this description is only given as an example and does not restrict the invention; the reference numbers relate to the enclosed drawings.

DETAILED DESCRIPTION OF THE PREFERRED EMBODIMENTS

In the different figures the same reference numbers relate to the same elements.

Figure 1:
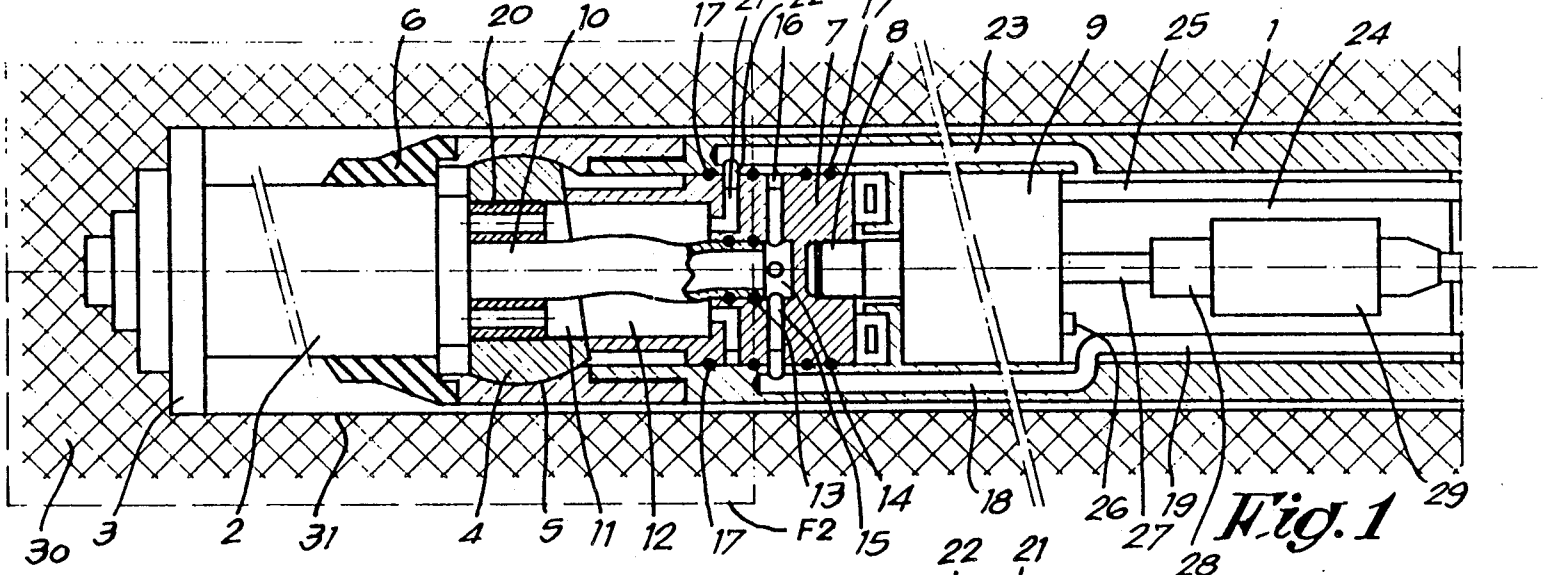
FIG. 1 presents a cross-section in the length of a steerable drilling mole according to the invention.
Figure 2:
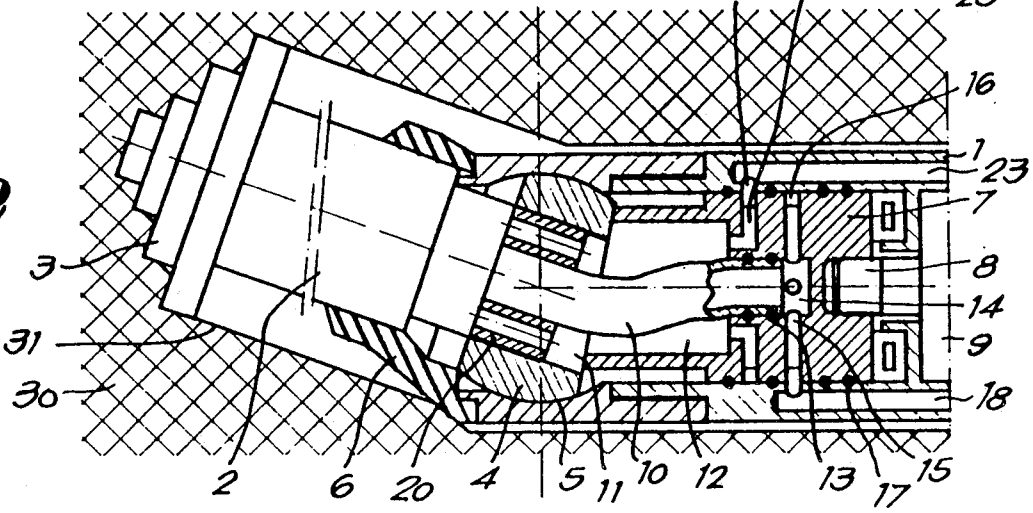
FIG. 2 presents a cross-section in the length analogue to that from FIG. 1 of a part of the drilling mole from this FIG. 1 but during the changing of the drilling direction.

The drilling mole according to FIGS. 1 and 2 has a round tubular body 1, a drilling instrument mounted in front thereof consisting of a stationary part that is formed by a pneumatic motor 2 and a drilling head 3, driven by the motor 2, mounted on the front extremity thereof. The drilling head 3 is provided with the necessary cutting elements and has an outer diameter which is slightly larger than the diameter of the body 1.

The drilling instrument 2, 3 is fixed to the body by means of a ball and socket joint 4, 5 of which the ball 4 is fixed to the housing of the motor 2 and the socket 5 is shaped on the inside of a front part of the body 1.

A rubber coupling sleeve 6 which is fixed on the front extremity of the body 1 is sealed tight on the outside of the housing of the motor 2.

The back of the ball 4 of the ball and socket joint 4, 5 is directed obliquely in relation to the longitudinal axis of the drilling instrument 2, 3. With this oblique back the ball 4 comes into contact with a front of a steering element 7 directed obliquely on the longitudinal axis of the body 1. This steering element 7, rotatable around the longitudinal axis of the body is situated in the latter. The steering element 7 is fixed on the shaft 8 of a compressed air motor 9 which is fixed in the body 1.

The angle of the oblique back of the ball 4 in relation to a perpendicular surface on the longitudinal axis of the drilling instrument 2, 3 is equal to the angle of the oblique front of the steering element 7 in relation to a perpendicular surface on the longitudinal axis of the body 1. Because of this, it is possible that this back and front so fit together that the longitudinal axis of the drilling instrument 2, 3 is situated in the extension of the longitudinal axis of the body 1 as presented in FIG. 1.

It is clear that the rotation of the steering element 7 with assistance of the compressed air motor 9 will result in a change in the inclination of the longitudinal axis of the drilling instrument 2, 3 in relation to the longitudinal axis of the body 1. The ball 4 does not rotate laterally after all and with its back is always in contact with the inclining front of the steering element 7.

In FIG. 2 the drilling mole is presented in the position whereby the drilling instrument 2, 3 is maximally inclined in relation to the body 1. The angle between the longitudinal axes of the drilling instrument 2, 3 and the body 1 is equal to twice the angle between the inclining fronts of the steering element 7 and a perpendicular surface on the longitudinal axis of the body 1.

The supply of compressed air to the pneumatic motor 2 occurs via a central flexible high pressure hose 10 which with its front extremity connected to the motor 2, extends through a central opening 11 in the ball 4 and a central opening 12 in the front part of the steering element 7, and with its rear extremity, is situated in the back part of this steering element 7. This rear extremity is also surrounded by sealing rings 13. This rear extremity exits in a central chamber 14 which through a number of radial channels 15 is connected with a groove 16 which extends around the outer girth of the rear extremity of the steering element 7 fitting against the inside of the body 1, between two sealing rings 17. Opposite this groove 16 a channel 18 exists that extends in a lengthwise direction in the wall of the body 1 and on the back of the motor 9 moves across in a pipe 19 which extends into the body 1.

The used compressed air leaves the motor 2 via outlets 20 which surround the high pressure hose 10 and exit in the aforementioned central openings 11 and 12. By means of channels 21 in the back part of the steering element 7 the central opening, 12 is connected with a groove 22 which, in a manner analogous to that of groove 16, extends around the rear extremity of the steering element 7, between two sealing rings 13. A channel 23 which stretches out in a lengthwise direction in the wall of the body 1 is connected with this groove 22. This channel 23 exits on the back of the motor 9 in the inner space 24 of the body 1. The compressed air is supplied to the pneumatic motor 9 which drives the steering element 7 through a pipe 25 which also stretches out into the inner space 24. The outlet 26 for the used compressed air exits straight in the inner space 24.

The drilling mole is connected in the usual manner to flexible high pressure pipes, which, for example, consist of two concentric pipes which reach above ground and are there wound up on a drum. For the sake of simplicity these high pressure pipes are not presented in the figures. The inner space 24 connects with one of these high pressure pipes. The pipes 19 and 25 exit, via valves controlled from above ground, in the other high pressure pipe or are each connected with a separate high pressure pipe. The connection of the drilling mole to these high pressure pipes also is effected in a known manner, preferably in such a manner that the drilling mole may be uncoupled from the high pressure pipes. In some cases the drilling mole may be fixed in a rotatable manner to the high pressure pipes.

Behind the motor 9, a number of detection apparatus are arranged in the inner space 24. Namely, a device 28 is fixed on a shaft 27 of the motor 9 in order to define the rotative position of this shaft and so also of the steering element 7, and a device 29 is fixed on this device 28 for limiting the inclination and the azimuth of the drilling mole.

Devices may also be mounted in the drilling instrument 2, 3 and more especially in the head 3 for limiting the inclination, the azimuth, the torsion and the depth through which relative readings and positionings are known.

In order to drill a tunnel 31 in the ground 30, for example under a street or a stretch of water, one places the drilling mole with the drilling instrument 2, 3 in the direction of the body 1, at an angle on the surface of the ground. Subsequently one starts the motor 2 through which the drilling mole thus drills into the ground 30 at an angle. Now by turning the steering element 7 with assistance of the motor 9, one alters the direction of the drilling instrument 2, 3 in relation to the lengthwise direction of the body 1 so that the direction of the drilling mole gradually changes into the horizontal direction and, when the drilling mole must again come up, even in an upward direction. Through the device 28 one may at any time precisely define the direction of the drilling instrument 2, 3 in relation to the body 1 and through the device 29 one knows precisely the direction of this body 1 so that from this information the drilling direction is also precisely to be derived.

Because the diameter of the head 3 is slightly larger than the diameter of the body 1 a hole or tunnel 31 in the ground 30 is obtained of which the diameter is slightly larger than the diameter of the body 1. Changing direction of the drilling instrument 2, 3 may therefore be achieved, also in dry grounds.

One may drill both in dry terrain as well as in saturated ground. If the stability of the ground would give problems one may push liquid under pressure around the body 1 for example from above the ground. The fact that all pipes are situated inside the body 1 and therefore also the drainage of the fluid for the motors is drained via the inside of the drilling mole is important when drilling in unstable ground such as in sand or clay.

The bending of the drilling mole in order to direct the drilling instrument 2, 3 may occur with a small force in view of the large leverage, this is the large distance between the ball and socket joint 4, 5 and the drilling head 3.

Figure 3:
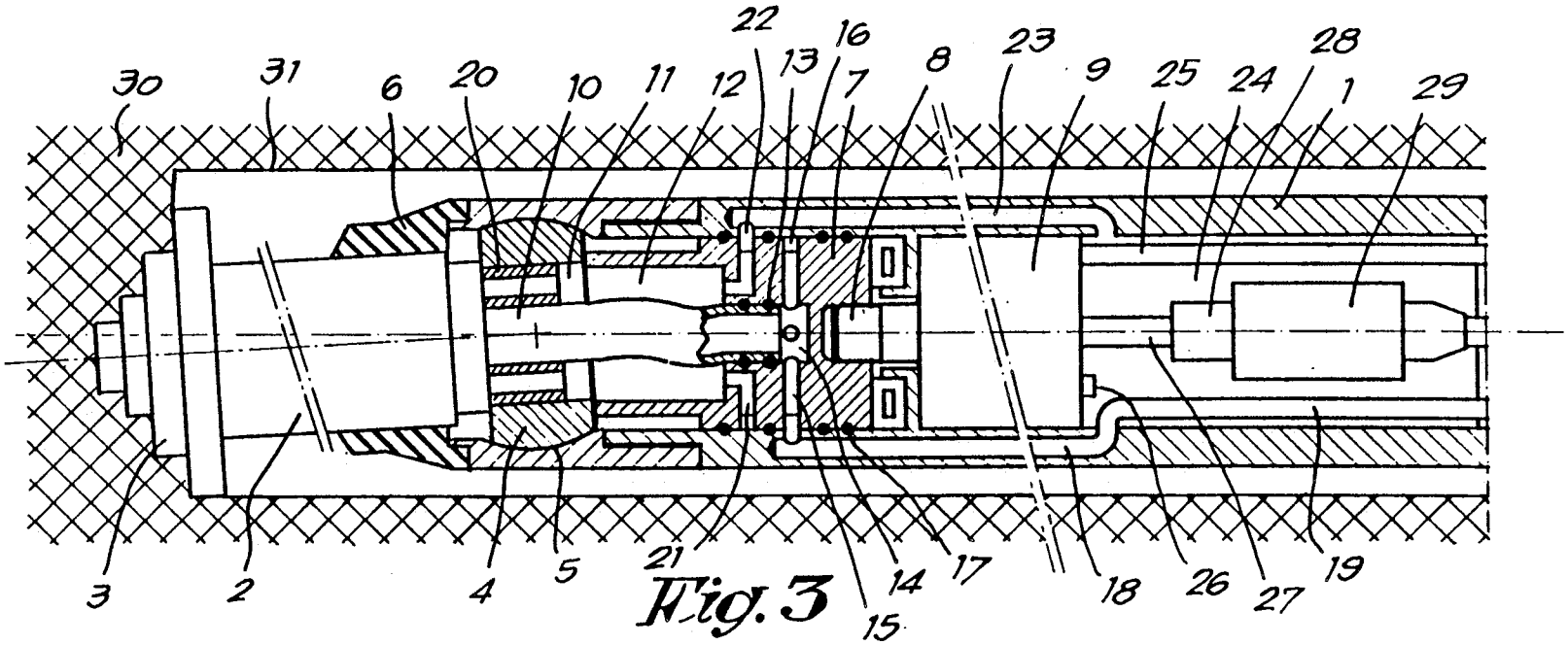
FIG. 3 presents a cross-section in the length analogue to that from FIG. 1 but in relation to another embodiment according to the invention.

The embodiment of the drilling mole according to FIG. 3 differs from the preceding embodiment described mainly in that the back of the ball 4 of the ball and socket joint 4, 5 is not oblique but directed perpendicular on the longitudinal axis of the drilling instrument 2, 3.

Because the front of the steering element 7 is directed obliquely in relation to the longitudinal axis of the body 1, so the back of the ball 4 is always directed obliquely on this longitudinal axis and so the longitudinal axis of the drilling instrument 2, 3 always makes an angle with the longitudinal axis of the body 1. The direction in which this angle is made so points to the right or to the left, upwards or downwards, and depends of course on the position of the steering element 7 round the longitudinal axis of the body 1.

By continuous even rotation of the steering element 7 the drilling mole will move straightforward in the ground 30. Furthermore, the lengthwise direction of the drilling instrument 2, 3 will always change direction so that the drilling head will in fact make a screw movement in the ground and a hole 31 will be drilled of which the diameter is larger than the diameter of the drilling head 3.

At the moment that one wishes to alter the drilling direction, it is sufficient to stop the motor 9 and thus the steering element 7 at the moment that the drilling instrument 2, 3 is pointed in the desired direction with its lengthwise direction.

The bent drilling mole will depict an arch and when the new direction is accepted may again drill straight by renewed continuous even rotation of the steering element 7.

Contrary to the first mentioned embodiment, with this embodiment the drilling mole may be directed in all directions.

In a variant of the embodiments described above, the drilling instrument 2, 3 is not a drilling head but a drilling hammer. The motor 2 is in this case a mechanism to effect a hammer movement on the drilling head 3 whether or not this drilling head 3 is rotated.

In another variant of the embodiments described above the steering element 7 is not rotated by means of a motor 9 but by a so-called turning cylinder to which a linear displacement is given by means of a cylinder-piston mechanism which through the turning cylinder is changed into a rotation.

The invention is in no way restricted to the embodiments described above, and in the scope of the patent application many changes may be applied to the embodiments described, among others to the shape, the construction, the arrangement and the number of the parts which are used for the realisation of the invention.

Especially the medium for both motors respectively for driving the drilling head and for driving the steering element need not necessarily be compressed air. This medium may also be a liquid under pressure. One of the motors may be driven by compressed air and the other by liquid under pressure, but in this case the outlets for the medium must of course be separated from each other.

I claim:

1. A steerable drilling mole for making a hole the ground, said steerable mole comprising:

a tubular body;

a ball and socket joint located in said body, a ball of said joint being disposed in a socket thereof and being longitudinally pivotable and laterally fixed with respect to a longitudinal axis of said body;

a guidable drilling instrument mounted on a front end of said body via a front surface of said ball;

a steering instrument mounted in said body and being laterally rotatable about said longitudinally axis of said body, said steering instrument having an oblique face in contact with a back surface of said ball; and means for rotating said steering instrument around said longitudinal axis, thereby guiding said drilling instrument with respect to said body.

2. A steerable drilling mole according to claim 1 wherein the shape of the back surface of said ball is oblique with respect to a longitudinal axis of said drilling instrument.

3. A steerable drilling mole according to claim 2, wherein the back surface of said ball forms an angle with a surface extending perpendicular to said longitudinal axis of said drilling instrument, which angle is approximately equal to an angle of the front of said steering element with respect to a surface extending perpendicularly to said longitudinal axis of said body.

4. A steerable drilling mole according to claim 1, wherein the back of surface said ball is perpendicular to said longitudinal axis of said drilling instrument.

5. A steerable drilling mole according to claim 1, wherein said drilling instrument comprises a portion connected to said ball, a driven head located in front of said portion, and means for driving said head.

6. A steerable mole according to claim 5, wherein said means for driving said head comprises a fluid motor enclosed by a housing and wherein said portion of said drilling instrument is formed by said housing.

7. A steerable mole according to claim 6, wherein said means for driving said head further comprises inlet and outlet pipes which extend through said ball, an inner space of said body, said steering element, and an outer wall of said body.

8. A steerable mole according to claim 1, wherein said means for rotating said steering element comprises a fluid motor.

9. A steerable mole according to claim 8, wherein said means for rotating said steering element further comprises inlet and outlet pipes which are attached to said fluid motor and which extend completely within said body.

10. A steerable mole according to claim 1, wherein said steering instrument has a diameter which is larger than the diameter of said body.

11. A steerable mole according to claim 1, further comprising an elastic coupling sleeve which is attached to the front of said body and which elastically surrounds said drilling instrument.

12. A steerable mole according to claim 1, further comprising a device mounted in said body and adapted to determine the rotative position of said steering element.

13. A steerable mole according to claim 1, further comprising a device disposed in said body and adapted to detect the inclination and the azimuth of said body.

* * * * *